United States Patent [19]

Garcia

[11] Patent Number: 4,913,311

[45] Date of Patent: Apr. 3, 1990

[54] SOAP LEAF DISPENSING SYSTEM

[76] Inventor: Nancy C. Garcia, P.O. Box 6221, Laguna Niguel, Calif. 92677

[21] Appl. No.: 250,098

[22] Filed: Sep. 28, 1988

[51] Int. Cl.[4] ..... B65D 83/08

[52] U.S. Cl. ..... 221/22; 221/25; 221/70; 221/305

[58] Field of Search ..... 221/6, 22, 25, 70, 71, 221/72, 52, 155, 305, 309; 206/77.1, 438, 804, 828

[56] References Cited

U.S. PATENT DOCUMENTS

| | | | |
|---|---|---|---|
| 1,122,108 | 12/1914 | Hamilton | 221/52 X |
| 2,409,362 | 10/1946 | Kleinmann | 221/70 X |
| 3,450,308 | 6/1969 | Schoenefeld | 221/305 |
| 3,613,142 | 10/1971 | Chaney | 221/25 X |
| 4,767,022 | 8/1988 | Oldorf | 221/305 X |

*Primary Examiner*—F. J. Bartuska
*Attorney, Agent, or Firm*—Richard C. Litman

[57] ABSTRACT

A soap leaf packet for individually dispensing packets from a stack thereof contained within a housing, includes a wrapper having a plurality of flaps foldable about a soap leaf and which are seguentially dispensable from the bottom of the stack. The wrapper is provided with a tab having two segments with one serving as a depending pull tab which, when activated, elevates one wrapper flap, thus pushing up an overlying wrapper flap, so that continued pulling on the tab opens up one flap and urges the other flap to engage the pull tab of the next-above packet, to insure its projection through a bottom opening in the housing and to cause the opening of the other flap. In this manner the contained soap leaf is automatically readied for grasping by the user.

7 Claims, 1 Drawing Sheet

SOAP LEAF DISPENSING SYSTEM

BACKGROUND OF THE INVENTION

Present methods of hand soap dispensing in public lavatories generally comprise liquid soap pumps, dry powder dispensers, individually wrapped small bars of soap or simply a bar of soap shared by all. Each of these methods is more or less wasteful of soap and is unhygienic and messy. This problem is exacerbated in lavatories on vehicles, where space is limited and the usage frequent.

The recent introduction of soap in thin bands or wafers, formed into small pieces which are completely consumed with each washing, is potentially neater and less wasteful than the earlier methods. A typical method of manufacturing such soap may comprise the extrusion of a liquid soap compound onto a paper or substitute backing, to provide a plurality of individual wafers on a continuous roll. The soap may then be dispensed by unrolling the paper and peeling the soap wafers off as required. This method has the disadvantage that more than one wafer is exposed while removing one, thereby exposing one or more of the remaining wafers to possible contamination. Obviously, such an arrangement is extremely wasteful and thus uneconomical.

By the present invention, an improved dispensable wafer or leaf soap construction is provided which avoids the drawbacks of known dispensing methods and yields a most economical and efficient manner of offering individualized soap leafs.

DESCRIPTION OF THE RELATED ART

In UK Patent No. 2,056,902 issued Mar. 25, 1981 to Lee there is disclosed an apparatus for producing, storing and dispensing bands of foamed detergent or soap. The soap, in a foamed viscous liquid form, is deposited as individual wafers onto a continuously moving paper backing, thence being dried in place and the paper then made up into a roll. The wafers are dispensed by unrolling the paper until a wafer is accessible and peeling it from the paper backing.

U.S. Pat. No. 1,122,108 issued Dec. 22, 1914 to Hamilton discloses a package comprising a receptacle or cabinet holding sheets of paper wherein the removal of one sheet automatically engages it with the next sheet, partially withdrawing it.

U.S. Pat. No. 4,589,544 to Shweinsberg, dated May 20, 1986 shows packet-shaped folders for storing flat articles, arranged one after the other and tab-interlocked so that raising the first file partially withdraws the second.

Neither these nor any other prior art known to the applicant employs a twice-folded tab to provide the combined operation of engaging the packet before it, serving as a handle for removing the packet from a housing or cartridge and which partially unwraps the withdrawn packet to expose the soap wafer for easy removal and use.

SUMMARY OF THE INVENTION

An object, advantage and feature of the present invention is to provide a novel construction of packaged individual wafers or leafs of thin soap or other consumable material of like form, the packages each having a separate wrapping which is cut and folded in such a fashion as to completely enclose the wafer and additionally provide an extended tab for grasping and removing a single packet from a stack of packets.

A further object is to fold each packet wrapping in a manner that when packets are stacked for dispensing, a projecting flap on the first packet is positioned to engage an extended tab on the second packet as the first packet is being withdrawn by pulling on its own extended tab.

Still another object is that the arrangement of folds in a pocket wrapper is such that in withdrawing a projecting tab, two flaps on the packet are unfolded to expose the contents for easy withdrawal.

Another object is to provide a dispensing apparatus particularly adapted for public use in vehicles, that is, quickly cleanable and serviceable, light in weight, compact and inexpensive to manufacture and maintain.

Another object is to provide a method of stacking the packets in the proper position with respect to the adjacent packets such that their relationship is maintained to effect the described lifting and unfolding action.

Another object is to provide a dispensing apparatus for a stack of packets having specifically folded wrappings with pressure means urging the bottommost stack packet through a slot through which a single packet can be withdrawn by means of an automatically extended tab exposed for easy grasping.

With these and other objects in view which will more readily appear as the nature of the invention is better understood, the invention consists in the novel combination and arrangement of parts hereinafter more fully described, illustrated and claimed with reference being made to the attached drawings.

DESCRIPTION OF THE PREFERRED EMBODIMENT

Figure 1:
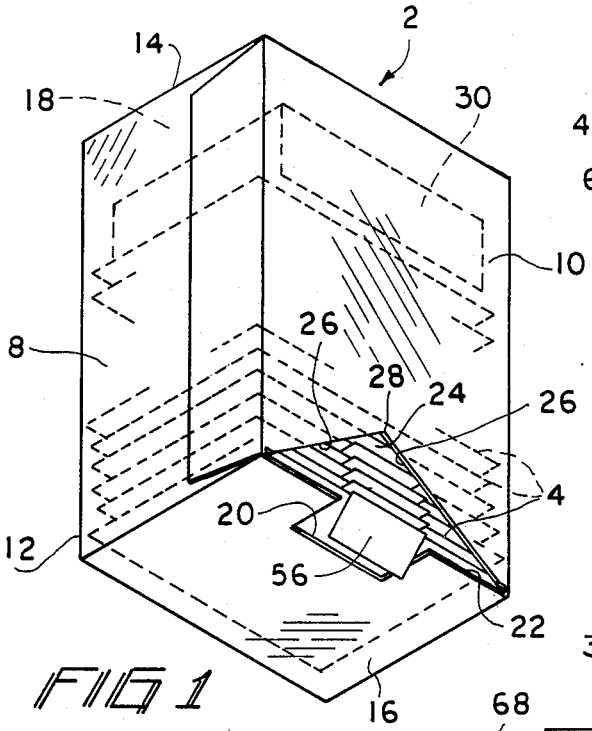
FIG. 1 is a perspective view of a container stocked with packets and illustrates means for withdrawing a single packet by grasping an extended tab and pulling perpendicular to the longitudinal axis of the container as well as parallel to the plane of the packet.
Figure 2:
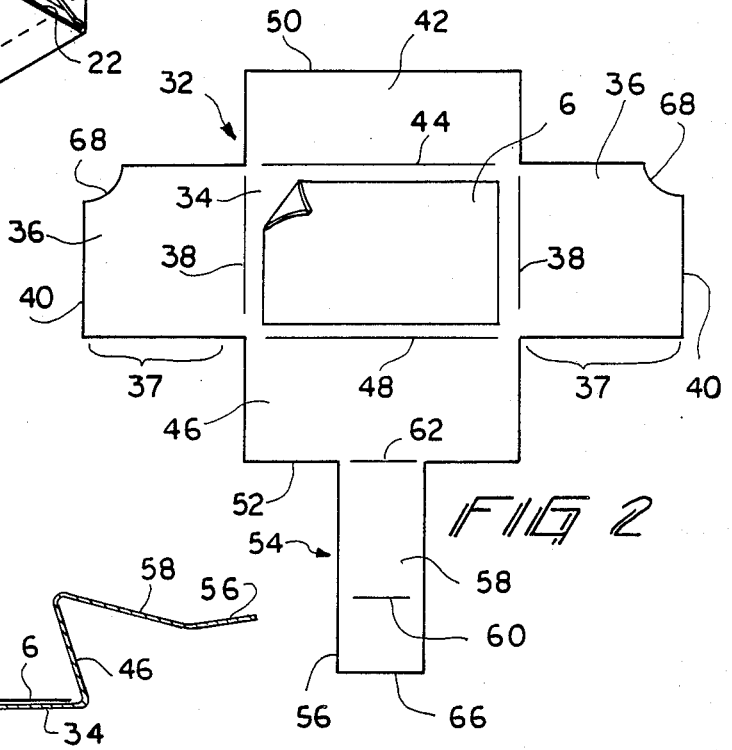
FIG. 2 is a plan view of the packet wrapper opened out and showing a soap leaf in place preparatory to folding the wrapper therearound.

Referring now to the drawings, particularly FIG. 1, the present invention will be seen to relate to a dispensing system including a housing or dispenser 2 containing a plurality of separate packets, generally designated 4, and which are intended to be individually dispensed or withdrawn from the housing 2 to provide the user with a single-use soap leaf or wafer 6, shown in FIG. 2.

The dispenser housing or container 2 comprises opposed side walls 8—8 joined to a front wall 10, back wall 12 and upper and lower walls 14,16 respectively, so as to provide an inner cavity 18 adapted to receive a substantial number of the packets 4. The container bottom wall 16 is formed with a cut-out or notch 20 in its forward edge 22 for reasons which will become apparent hereinafter. The front wall 10 also is provided with an opening 24 preferably forming a triangular cut-out as defined by two upwardly and inwardly inclined edges of the front wall 10. Such an opening 24 will be understood to provide ready means for a user or maintenance personnel to easily recognize that a limited number of packets 4 remain in the container 2. It will be appreciated that in view of the triangular configuration of the cut-out 24, as soon as the last or uppermost packet 4 in the container passes below the apex 28 of the opening 24, a clear visible signal is conveyed as to the limited number of packets remaining. In view of the opening edges 26, which slant all the way to a point just short of the lower wall 16, it will be seen that complete containment of the remaining packets is assured by at least some portion of the front wall 10. Alternatively, openings 24 of various other configurations may be utilized.

An appropriate follower 30 is positioned within the cavity 18 atop the uppermost packet 4 to positively advance all of the packets downwardly, following the withdrawal of each packet from the bottom, as will be described later. This follower 30 may comprise any block of any suitable material of nominal mass so as to assist the gravitational force acting upon the stack of packets 4. Since the dispenser 2 may be mounted or disposed in other than a vertical position, it will be understood that a spring-urged follower mechanism may be employed but otherwise the cost of such mechanism is an unnecessary expense in the production of the instant economical system.

The specific construction of the individual packets 4 is most critical and is shown most clearly in FIG. 2 of the drawings wherein it will be seen that each packet comprises an envelope or wrapper 32 formed from a single blank of appropriate material such as paper or plastics. The selected material will be understood to possess a minimal degree of stiffness for reasons which will become obvious following a description of the operation of the present dispensing system.

The wrapper blank will be seen to include a rectangular bottom panel 34 having major and minor dimensions, comprising the largest portion of the wrapper, and upon which the soap leaf or wafer 6 is disposed. Extending from each short end of the bottom panel 34 is a side flap 36, with the juncture therebetween defining a side fold 38. Each side flap 36 extends from the bottom panel 34 a distance greater than one-half the longitudinal extent of the bottom panel, as depicted at 37, such that when the two side flaps 36—36 are folded toward one another, the outer edges 40—40 thereof will overlap to fully contain the soap wafer 6. Notches 68 in side flaps 36—36 insure preliminary access to the wafer 6 when the flaps are closed. With continued reference to FIG. 2, it will be noted that a rear flap 42 extends from one other edge or rear fold 44 of the bottom panel while a front flap 46 projects from a front fold 48, along the remaining edge of the bottom panel. Again, when the two latter flaps 42,46 are folded toward one another, the outer edges 50 and 52 thereof will overlap to fully contain the soap wafer 6 to insure the full envelopment of the soap wafer 6 within the wrapper 32, prior to its being dispensed from the housing 2.

An important feature of the present invention involves the construction and cooperating relationship of a tab 54 integral with the wrapper front flap 46. This tab 54 extends normal to, and from the intermediate portion of the flap outer edge 52 and includes an outermost, pull segment 56 joined to a top segment 58 and providing an intermediate fold line 60. The axial extent of the top segment is equal to the distance between the front flap fold line 48 and the outer edge 52 while the shorter pull segment 56 is of an axial extent less than the minor dimension of the bottom panel 34 and more particularly, as will be seen from FIG. 2, is less than the minor dimension of the bottom panel 34 minus the minor dimension of the rear flap 42.

Figure 3:
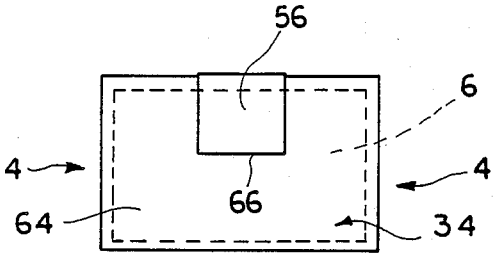
FIG. 3 is a bottom plan view of the folded packet.
Figure 4:
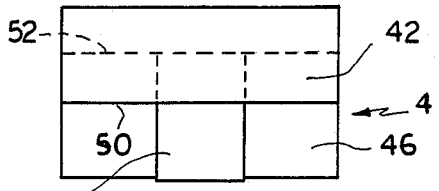
FIG. 4 is a top plan view of the packet shown in FIG. 3.

Each separate packet 4 is completed by folding the wrapper 32 about a contained soap wafer 6, to arrive at the ready packet as shown in FIGS. 3 and 4 of the drawings. This operation involves, initially, sequentially folding the two side flaps 36—36 inwardly into an overlapping arrangement and, subsequently, folding the front flap 46 inwardly and over the folded side flaps. The tab 54 is folded 180 degrees about an end fold line 62 such that its top segment 58 flushly engages and fully overlaps the undersurface 64 of the front flap portion of the wrapper blank. The remaining tab pull segment 56 is then folded 180 degrees, along its fold line 60 which will be understood to engage and wrap around the fold line 48 also. From a review of FIGS. 3 and 4 it will be seen that the extents of the free edge 66 of the tab pull segment 56 and the outer edge 50 of the rear flap 42 on the other side of the packet are such that the sum of their two extents is less than the minor extent of the bottom panel 34. Some minor deviation from the above-described dimensional relationships may exist with the present invention as long as the tab free edge 66 is both accessible through the container bottom wall opening 20 as well as engageable with the rear flap outer edge 50 of the packet therebeneath, as will become apparent from the description of the operation of the present system, next following.

A plurality of the above-described packets 4 are stacked one upon another within the cavity 18 of the housing 2, each with the undersurface 64 of the bottom panel 34 facing downwardly, or toward the container lower wall 16. In this position, all the tab pull segments 56 will be beneath the respective packets and have their intermediate fold lines 60 substantially in the plane of the container front wall 10.

Figure 5:
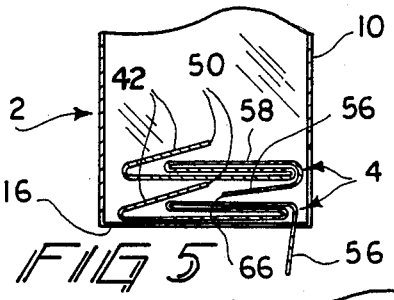
FIG. 5 is a side elevation of a portion of the container illustrating the packets sufficiently separated to show the relative position of the folds and tabs thereon, with the bottom packet ready to be dispensed.
Figure 6:
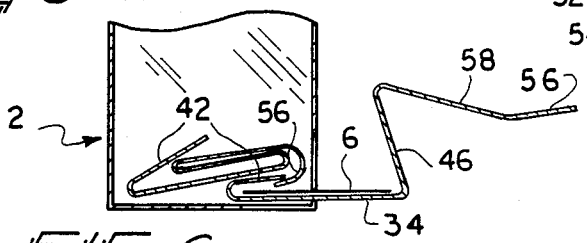
FIG. 6 is a side elevation of a portion of the container illustrating a first packet partially withdrawn and partially open and its engagement with the tab on the second packet.
Figure 7:
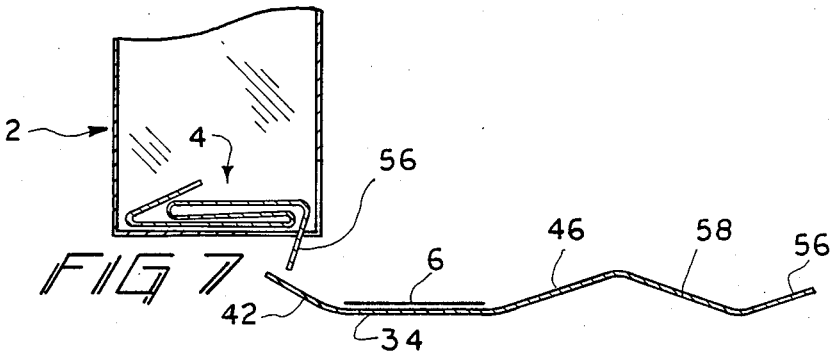
FIG. 7 is a side elevation of a portion of the container illustrating a first packet completely withdrawn and open and a second packet with the withdrawal tab extended.

FIGS. 5-7 depict the operation of the various components of the packets during the removal of individual ones of the packets from the bottom of the housing 2. The inherent stiffness of the material of the bottommost wrapper blank 32 insures that the tab pull segment 56 will project downwardly through the container cut-out 20, as shown in FIGS. 1 and 5, so that a user need merely grasp this tab segment and pull straight out, in a plane substantially coplanar with the thickness of the packet 4. During this motion, the top segment 58 of the tab urges the packet front flap 46 upwardly and forwardly. With the present construction, this latter displacement insures two actions. First, the initial raising of the front flap outer edge 52 also elevates the outer edge 50 of the rear flap 42, since this latter flap was overlying the front flap. Also, the resultant elevation of the front flap 46 causes the undersurface 64 of the bottom panel 34 of the next-above packet to be tilted upwardly, in the area of the housing front wall 10, thus allowing the tab pull segment 56 of the next upper packet to extend downwardly, with its free edge 66 disposed in a plane lower than that of the elevated bottom packet front flap outer edge 52.

In the foregoing manner, the continued withdrawal of the bottom packet will be seen to cause both the front and rear flaps 46,42 of the packet to be opened. The very pulling force being applied to the tab 54 of course fully unfolds the front flap 46 after its outer edge 52 has cleared the container front wall 10, while the rear flap 42 is unfolded due to the momentary captive engagement of the tab pull segment 58 of the next-above packet, beneath the bottom packet rear flap 42. This latter engagement also insures that when the bottom packet is fully removed from the housing 2 the tab pull segment 58 of the new bottom packet 4 will be extending downwardly, ready for the next user.

From the above it will be appreciated that the simple withdrawal of a packet 4 by pulling on the tab 54 will provide a user with a substantially exposed soap leaf 6, ready for use. although no mechanical interaction is provided to automatically unfold the two side flaps 36—36, it will be understood that, again, the inherent stiffness of the wrapper material will assist in providing ready access to the soap leaf 6. In other words, by not applying excessive force along the fold lines 38—38 during the assembly of the packets it will follow that the natural resilience of the material will encourage the side flaps to assume an elevated posture following the opening of the front and rear flaps, thereby further exposing the soap leaf to ready grasping and use. Still further access to the soap leaf 6 is assured by notches 68 in side flaps 36—36, which permit grasping the soap leaf 6 while the side flaps 36—36 are still partially closed.

To guide the user in the operation of the invention, appropriate instructions are preferably printed on the housing 2.

It will be further appreciated that should the stiffness of the wrapper material or other characteristics of the packet prevent packet withdrawal in the described fashion, the packets may be joined together by releasably adhesive means to increase the pulling forces during withdrawal. The adhesive separation forces would be necessarily limited to allow the packets to separate one from the other when the packet is completely withdrawn.

Likewise, should it be desired to seal the individual packets to further protect the contents against tampering or contamination, the invention contemplates the use of a releasable adhesive to accomplish this. Assistance could be required to open any of the flaps, in addition to the natural urging of the folded material.

I claim:

1. A dispensing system for planar articles of manufacture comprising;

a container having bottom, back, front and opposite side walls intersecting to provide an interior cavity therebetween, the intersection between said front and bottom walls provided with an opening, a plurality of separate, detached packets stacked atop one another within said container cavity with a bottom most one of said packets juxtaposed said container bottom wall adjacent said opening, each said packet comprising a unitary wrapper including a central, rectangular bottom panel having opposite side flaps joined to said bottom panel by respective side folds, front and rear flaps joined to said bottom panel by respective front and rear folds intermediate said side folds, said front and rear flaps each having an outer edge opposite its respective said fold, a tab extending from said front flap outer edge and joined thereby by an end fold, said tab having a top segment extending from said end fold and joined to a pull segment by an intermediate fold, said pull segment terminating in a distal free edge, a planar article of manufacture disposed atop said packet bottom panel with said side flaps inwardly folded along said side folds and directly overlying said article of manufacture atop said bottom panel, said front flap inwardly folded along said front fold and overlying said folded side flaps with said tab top segment folded along said end fold and overlying said folded front flap to position said intermediate fold juxtaposed said front fold whereby, said pull segment angularly extends beneath said intermediate fold, said rear flap inwardly folded along said rear fold and overlying said folded front flap, said bottom most one of said packets within said container cavity having said pull segment projecting through said opening, said pull segments of all said stacked packets atop said bottom most packet inwardly folded along said intermediate fold to underlie its respective bottom panel and overlie said tab top segment of the next beneath said packet, said outer edge of each said packet rear flap spaced from said free edge of said pull segment of the next above said packet, whereby a user upon pulling said pull segment of said bottom most packet, progressively withdraws the bottom most packet through said container opening initially with said rear flap outer edge thereof thereafter passing over said free edge of said pull segment of the next above one said packet and thence said rear flap of said bottom most packet subsequently overlying said pull segment of the next above one said packet and becoming sandwiched between said pull segment and bottom panel of said next above packet, with continued withdrawal of the bottom most packet causing unfolding of said rear flap of said bottom most packet and deflection of said pull segment of the next above packet, leaving said pull segment of the next above packet extending through said container opening as said bottom most packet is fully withdrawn with its front and rear flaps unfolded whereafter, with unfolding of said side flaps of the withdrawn packet, the article of manufacture atop the bottom panel thereof may be removed for use.

2. A dispensing system according to claim 1 wherein, said article of manufacture within each said packet wrappers comprises a soap wafer.

3. A dispensing system according to claim 1 including, a cut-out portion on said side flaps whereby, full unfolding of said side flaps of said packets following withdrawal from said container is facilitated by permitting a user to grasp said side flaps at said cut-out portions.

4. A dispensing system according to claim 1 wherein, said side flaps each include an outer edge, and said inwardly folded side flaps are disposed with one said side flap outer edge overlying the other said side flap outer edge.

5. A dispensing system according to claim 1 wherein, said bottom most packet bottom panel is flushly supported in a planar manner from said front fold to said rear fold and from one said side fold to the other said side fold.

6. A dispensing system according to claim 1 including, a notch within said container bottom wall communicating with said container opening, and said pull segment of said bottom most packet is disposed through said notch prior to withdrawal of said bottom most packet.

7. A dispensing system according to claim 1 wherein, said container opening is bounded by inclined edges in said container front wall, angled upwardly and inwardly from said container bottom wall.

* * * * *